United States Patent [19]

Sugiura et al.

[11] Patent Number: 4,919,714

[45] Date of Patent: Apr. 24, 1990

[54] METHOD AND APPARATUS FOR REFINING STEEL

[75] Inventors: Saburo Sugiura; Senji Fujita, both of Nagoya; Hiroya Nakata; Tetsuo Okamoto, both of Chita; Yoshio Inagaki, Aichi; Keiichi Mizuguchi; Atsushi Ishii, both of Tokai, all of Japan

[73] Assignee: Daido Tokushuko Kabushiki Kaisha, Nagoya, Japan

[21] Appl. No.: 270,859

[22] Filed: Nov. 14, 1988

[51] Int. Cl.[5] ..... C21C 7/00

[52] U.S. Cl. ..... 75/529; 75/532; 75/533

[58] Field of Search ..... 75/51.1, 51.2, 59.22

[56] References Cited

U.S. PATENT DOCUMENTS 3,953,199 4/1976 Michaelis ..... 75/59.2

4,195,985 4/1980 Brotzmann ..... 75/51.2

*Primary Examiner*—Peter D. Rosenberg

*Attorney, Agent, or Firm*—Armstrong, Nikaido, Marmelstein, Kubovcik & Murray

[57] ABSTRACT

Disclosed are an improved method of refining steel and an apparatus for practicing the method.

The refining method comprises, basically, carrying out the refining, particularly, decarburization, while stirring molten steel in the refining furnace by injecting gas thereinto, while supplying heat with a burner installed at the top of the furnace to the molten steel. According to this method, it is possible to start at an initial carbon content of the moltend steel lower than that of known AOD process, and complete the refining in a curtailed period of time and with a decreased oxidation loss of Cr. Thus, damage of refractory materials of the furnace is reduced, and the amount of Si necessary for reducing Cr-oxides in the latter stage of the refining is also reduced.

Oxygen for the decarburization is supplied usually in the form of gas, but can be supplied from a solid oxygen source. In an alternative of the present method, powdery metal oxide, which is reducable equally to or more easily than Cr-oxides, is shot into the furnace through the burner or injected into the molten steel through a tuyere or an immersed lance.

Preferably, the burner is of a type of variable flame length. Use of the burner disclosed here makes it possible to lengthened the flame at the former stage of the refining so that not only heat but also oxygen may be supplied to the molten steel surface of promoting the decarburization, and to shorten the flame at the latter stage of the refining so that only heat may be supplied.

16 Claims, 13 Drawing Sheets

METHOD AND APPARATUS FOR REFINING STEEL

BACKGROUND OF THE INVENTION

1. Field of the Invention

The present invention relates to a method of refining steel, particularly, decarburizing various steels such as low carbon steel, carbon steel, low alloyed steel, alloyed steel and stainless steel. The invention encompasses an apparatus for practicing the refining method.

2. State of the Art

As is well known, VOD process (vacuum oxygen decarburization) and AOD process (argon oxygen decarburization) are often used for refining various steels, particularly, stainless steel containing Cr.

AOD process is the most typical method of refining, which comprises injecting Ar gas with oxygen gas into molten steel to conduct decarbuzization while suppressing oxidation loss of Cr by lowering CO partial pressure, and, as the decarburization proceeds from the high carbon state to the low carbon state, changing the $O_2$/Ar ratio of the gas injected into the molten steel so that the decarburization proceeds efficiently. As the gas for diluting $O_2$, instead of expensive Ar, $N_2$ may be used, or alternatively, steam may be used (CLU process).

The AOD process is conducted without additional heat to the molten steel, and therefore, it is usual to start the refining at a high carbon state such as 1.0–2.0 weight % in the molten steel so as to utilize the heat of oxidatin reaction of the carbon and to prevent temperature decrease during the refining.

In such a process, the period for the decarburization becomes necessarily long. Also, it is inevitable that a portion of Cr is oxidized, and the oxide must be reduced afterward by using expensive metallic Si. Further, it is not easy to control temperature of the molten steel to be tapped. These are the problems inherent in AOD process.

SUMMARY OF THE INVENTION

An object of the present invention is to provide a method of refining steel, which makes it possible to shorten the period of decarburization, to lower oxidation loss of valuable metals such as Cr, and thereby to shorten the period for reducing the Cr-oxides in the latter stage of refining as well as to decrease consumption of the reducing material.

Another object of the invention is to provide an apparatus suitable for practicing the above method of refining steel, particularly, the apparatus using a burner with which length of the flame can be easily varied.

The method of refining steel according to the present invention can be carried out by using an apparatus with heating means, such as arc furnace, or an apparatus without heating means, such as AOD furnace, CLU furnace, VOD furnace, and further, even a converter.

BRIEF EXPLANATION OF THE DRAWINGS

FIG. 6 shows the data in a relatively high carbon state, and FIG. 7, the data in a relatively low carbon state.

FIG. 11 is the figure seen from the top end of the burner, and FIG. 12, a longitudinal sectional view of the top end.

FIG. 13 is a graph showing the relation between primary oxygen ratio and flame length, and FIG. 14 is a graph showing the relation between "M-value" and flame length.

FIG. 15 is a graph showing decrease of C-content and increase of temperature of the molten steel at the earlier state of decarburization, and FIG. 16 is a graph showing loss of Cr and increase of temperature of the molten steel at the latter stage of decarburization.

DETAILED EXPLANATION OF PREFERRED EMBODIMENTS

The method of refining steel of the present invention comprises carrying out the refining under stirring the molten steel contained in a furnace such as an electric furnace, a convertor, or a refining vessel (e.g., AOD furnace and VOD furnace) by injecting gas there into, and supplying heat from a burner which is installed at the top of the furnace and burns a fuel such as heavy oil, powdered coal or natural gas to the molten steel through the surface thereof enlarged due to the stirring.

The gas to be injected into the molten steel in the furnace may be either an oxidative gas ($O_2$ or $O_2$-enriched air) which causes the decarburization reaction in the molten steel, or an inert gas (e.g., Ar and $N_2$). Further, both of the oxidative gas and the inert gas may be used in such a way that the former is surrounded by the latter so as to protect the tuyere.

The oxidative gas supplied to the burner may be air It is, however, preferable to use pure oxygen gas or gas containing 30 volume % or more of $O_2$ (such as mixed gas of $O_2$ with $N_2$ or Ar) so that the flame may be of a higher temperature.

The flame from the burner is preferably so directed that it may jet to the surface of the molten steel.

In the carbon content range of the molten steel where the decarburization reaction rate is determined by the oxygen supply rate, i.e., usually about 0.30 weight % or more of C, it is advisable to supply $O_2$ of the amount more than theoretically necessary for burning the fuel so that the CO generated on the molten steel surface due to the decarburization reaction may be burnt to $CO_2$ and that the heat energy of the reaction may be utilized. The energy of burning is absorbed by the molten steel through the surface thereof enlarged due to the stirring and raises the temperature of the molten steel.

Supplying $O_2$ in the amount excess to the theoretically necessary amount for burning the fuel can be done either by increasing the amount of the oxidative gas supplied to the burner or by supplying additional $O_2$ to the molten steel surface separately to the supply through the burner.

The apparatus for practicing the present method of refining steel comprises a furnace body to contain the molten steel, gas supply means to inject a gas for stirring the molten steel in the furnace, a burner supplying heat to the molten steel through the surface thereof enlarged by the stirring, and means for supplying fuel and oxygen to the burner. A practical apparatus is equipped with a CO-measuring means to determine the CO-content in the exhaust gas form the furnace. When necessary, further means for supplying $O_2$ to the molten steel surface separately to the burner is installed.

Figure 1:
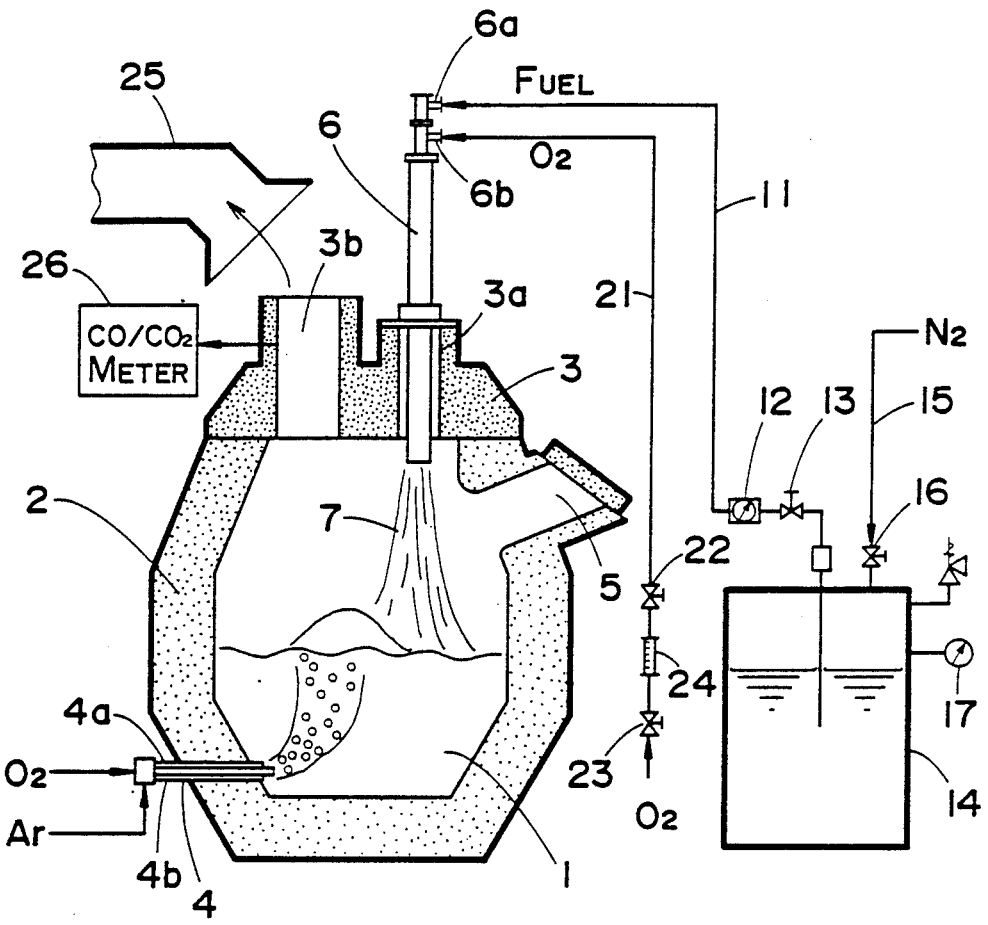
FIG. 1 is a longitudinal sectional view of an apparatus for refining steel used in a basic embodiment of the present invention.

FIG. 1 shows an embodiment of the present apparatus. The refining apparatus has a furnace lid 3 on the furnace body 2 which contains molten steel 1, and the furnace body is equipped with a tuyere 4 at the lower part thereof, which tuyere comprises an inner tube 4*a* for injecting $O_2$ gas and an outer tube 4*b* for injecting Ar gas. The tuyere 4 constitutes the gas supplying means for stirring the molten steel. The furnace body 2 has an inclined tapping mouth at the top thereof. The furnace lid 3 is equipped with a burner 6, which supplies heat to the surface of the molten steel 1. The burner 6 has a conduit 6*a* to the fuel supplying means and a conduit 6*b* to the $O_2$ supplying means, and the structure of the burner is such that can be cooled. The burner 6 is installed in the vertical direction so that the flame 7 from the burner 6 may be jetted to the molten steel surface. Thus, supply of heat to the molten steel surface can be done efficiently through the surface enlarged due to the stirring, and $O_2$ is blown in the direction reverse to the stream of CO gas generated on the molten steel surface so that burning of the CO gas may occur near the surface.

The fuel supply means for supplying fuel to burner 6 comprises a fuel line 11, a flow meter 12, a valve 13, a fuel tank 14, a pressurized medium supply line 15, a valve 16 and a pressure gauge 17. The $O_2$ (pure oxygen gas or a mixed gas containing $O_2$) supply means comprises an $O_2$ line 21, valves 22 and 23, and a flow meter 24.

The furnace lid 3 has, in addition to the hole 3*a* for inserting the burner 6, an outlet 3*b* for exhaust gas, so as to introduce the exhaust gas into a dust correcting hood 25. The exhaust gas outlet 3*b* is equipped with a CO/-$CO_2$-meter for determining the $CO/CO_2$ ratio in the exhaust gas.

For refining steel, $O_2$ gas is injected into the molten steel contained in the furnace body 2 through the inner tube 4*a* of the tuyere 4 and Ar gas through the outer tube 4*b* to effect stirring and decarburization of the molten steel, and the flame 7 from the burner is directed to the molten steel surface enlarged due to the stirring, thereby supplying the heat to the molten steel instead of conventional heat supply by heat of oxidation raction of C.

According to the present method of refining steel, different from the conventional technology, it is not necessary to use an initial carbon content in the molten steel prior to refining so high as 1.5–2.0 weight % for the purpose of sufficient heat supply, but it is possible to reduce the initial carbon content as low as 0.8 weight %. This shortens the necessary period for the decarburization, and suppresses oxidation of valuable metals such as Cr, thereby reduces consumption of Si used for reduction of the valuable metal oxides. Decrease of the reducing agent consumption results in formation of less slag and shortens the period necessary for removing the slag. Shortened refining period also results in less damage in the refractory materials.

It is preferable to use, as the oxidative gas supplied to the burner 6, a mixed gas containing more than 30 volume % of $O_2$ or even pure oxygend gas to obtain flame 7 of a higher temperature. The decarburization reaction will be further promoted and oxidation loss of the valuable metals such as Cr can be thus reduced.

In the process of refining, at the range of carbon content of the molten steel where the decarburization rate is determined by oxygen supply (as noted above, usually, C: 0.30 weight % or more), CO gas in the amount corresponding to the amount of $O_2$ supplied through the inner tube 4*a* of the tuyere 4 is generated on the molten steel furface. It is preferable to determine the generated amount of CO by the $CO/CO_2$-meter 26 and supply $O_2$ in the amount more than theoretical necessity for the fuel through the $O_2$ line 21 or a separately equipped (not shown in the Figures) $O_2$-injecting nozzle to the molten steel 1 so as to burn the CO generated from the molten steel surface into $CO_2$.

The oxygen to be supplied to the molten steel as noted above may be not only in the form of gas, but also in the solid state. Thus, an alternative of the present method of refining steel comprises carrying out the refining while stirring the molten steel in the furnace by injecting gas, while supplying heat through the burner equipped at the top of the furnace to the molten steel through the surface thereof enlarged due to the stirring, and while supplying a solid oxygen source in the powder form to the burner by a carrier gas so as to shoot the powder to the molten steel surface with the flame.

Examples for one of the groups of the solid oxygen source are: oxides of metals which are equally to or more easily reduced as chronium oxides, such as chromite sand, mill scale, iron ore, nickel oxide, molybdenum oxide and tangsten oxide. Another group comprises substances which decompose at the temperature of the molten steel to generate $CO_2$ such as carbonates and bicarbonates of calcium, sodium and barium.

Both of the above solid oxygen sources give good results when they are in the form of relatively fine powder, such as those of particle size 500 micron or less.

As the carrier gas, whole or a part of the $O_2$ gas for burning the fuel may be used. In some cases, air or $O_2$-enriched air will do.

As the gas to be injected into the molten steel in the furnace, inert gas such as Ar is the most preferable. If there is no problem, depending on the kind of steel, $N_2$ may be use. From the view to promote the decarburization, it is necessary to inject an oxidative gas ($O_2$ gas or a gas containing large quantity of $O_2$) having decurburization effect in the molten steel. It is preferable, as done in the AOD process, to use both Ar gas and the oxidative gas.

In the decarburization reaction of the molten steel with use of $O_2$ gas, as noted above, oxygen supply is rate-determining when the carbon content is high, and carbon diffusion in the molten steel becomes rate-determining as the carbon content becomes low. Under the latter condition, even if the amount of the injected $O_2$ gas is increased to strengthen supply of oxygen, it is difficult to disperse the $O_2$ gas uniformly in the molten steel, and the excess $O_2$ is consumed by oxidation of expensive Cr. Thus, because of the low effect of decarburization and vigorous sprash of the molten steel, it is not possible to promote the decarburization only by increase of the amount of supplied $O_2$ gas.

When the solid oxygen source in the form of powder is supplied to the burner and shot to the molten steel surface with the flame according to the alternative of the present invention, the solid oxygen source is caught by the surface vigorously moving due to the stirring and disperses uniformly in the molten steel to move even to the zone where the gas does not disperse.

The solid oxygen source reacts in the molten steel as follows and contributes to the decarburization: in cases of easily reducable metal oxides, for example, $$Fe_2O_3+C \rightarrow 2FeO+CO$$

$$FeO+C \rightarrow Fe+CO$$

$$Cr_2O_3+3C \rightarrow 2Cr+3CO$$

and in cases of carbonates and bicarbonates, $$CaCO_3 \rightarrow CaO+CO_2$$

$$2NaHCO_3 \rightarrow Na_2O+2CO_2+H_2O$$

$$CO_2+C \rightarrow 2CO$$

thus supply of oxygen to whole the molten steel occurs quickly and the decarburization proceeds quickly.

Because the interface of the reaction increases as the particles of the solid oxygen source is fine, it is preferable to use finely divided powder of 500 micron or less, as noted above.

The solid oxygen source is added with the flame and, after being heated, dispersed in the molten steel. Because all the above decarburization reactions are endothermic, heating and temperature rise of the solid oxygen source itself prior to the addition effects favorable for promoting the reactions. In cases where the carbonates or bicarbonates are used as the solid oxygen source, it is considered that at least a part of the above decomposition reactions will occur in the flame, and that the $CO_2$ thus generated is jetted to the molten steel surface and causes the following reaction which helps the decarburization.

$$C+CO_2 \rightarrow 2CO$$

The above described alternative of the present refining method also shortens the period necessary for the decarburization. As the results, the oxidation loss of valuable metals such as Cr is decrease.

Supply of the solid oxygen source can be carried out not only through the burner as described above, but also by other means.

Another alternative of the present method of refining comprises carrying out the refining while stirring the molten steel in the furnace by injecting gas, while supplying heat through the burner equipped at the top of the furnace to the molten steel through the surface enlarged due to the stirring, and while supplying a solid oxygen source in the form of powder through a tuyere or an immersed lance.

The powdery solid oxygend source added to the molten steel in accordance with this alternative disperses uniformly in the molten steel to move to the zone where the gas does not go. The solid oxygen source reacts in the molten steel as explained above to contribute the decarburization. As the results, oxygen supply to whole the molten steel proceeds quickly, and the period necessary for the decarburization is shortened.

Figure 9:
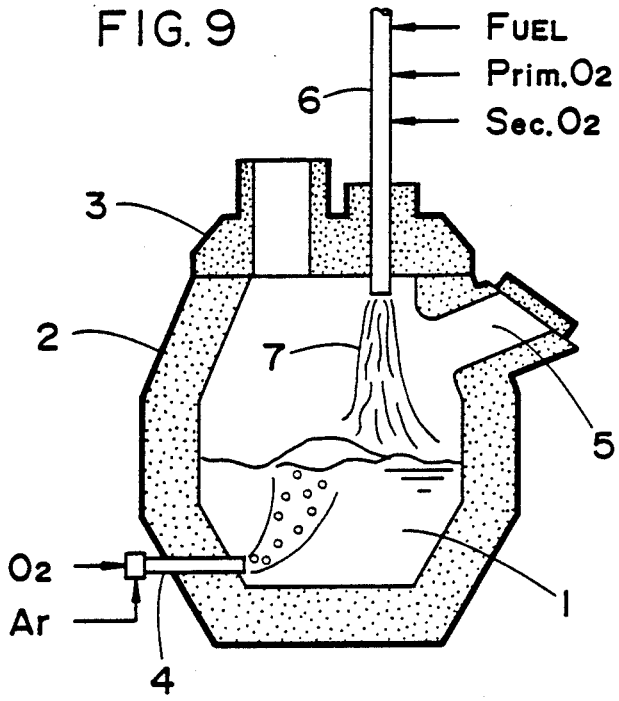
FIG. 9 and FIG. 10 are longitudinal sectional views of a typical apparatus for refining steel used in a preferred embodiment of the invention, shown for explanation of the principle thereof.
Figure 10:
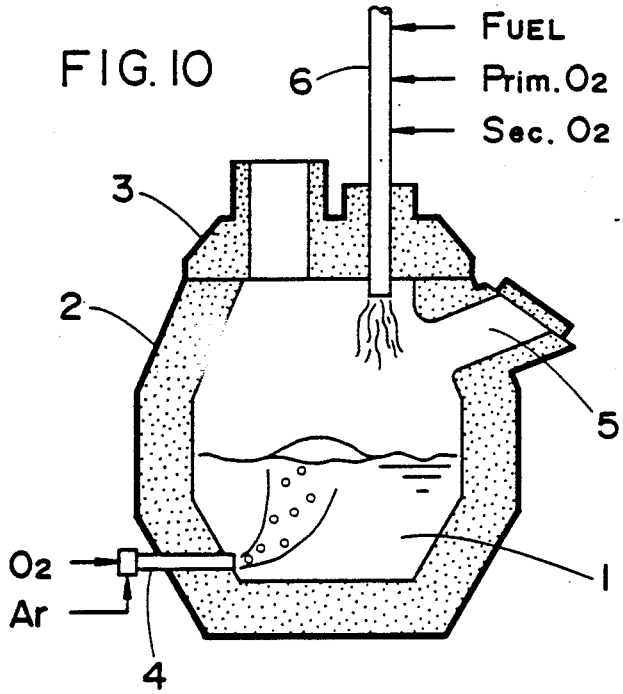

Still other alternative of the present refining method uses a burner preferably, an oxygen burner with which the flame length can be varied. As illustrated in FIGS. 9 and 10, refining is carried out while the molten steel 1 is stirred by injecting a gas thereinto, while supplying heat to the molten steel through the surface enlarged due to the stirring. In the former stage of the decarburization the flame 7 of the burner is long as seen in FIG. 9 so as to jet the fleu gas to the molten steel 1 for promoting the decarburization, and in the latter stage of the decarburization the flame of the burner is short as seen in FIG. 10 so as to give only heat to the molten steel.

Change of the flame length is done preferably at the time when the C-content in the molten steel decreases to such level that the rate determining step of the decarburization reaction changes from oxygen supply to carbon diffusion in the molten steel. Flame length is usually made binarily (long-short), and this is sufficient, but may be stepwisely with many more steps or even gradually.

Figure 11:
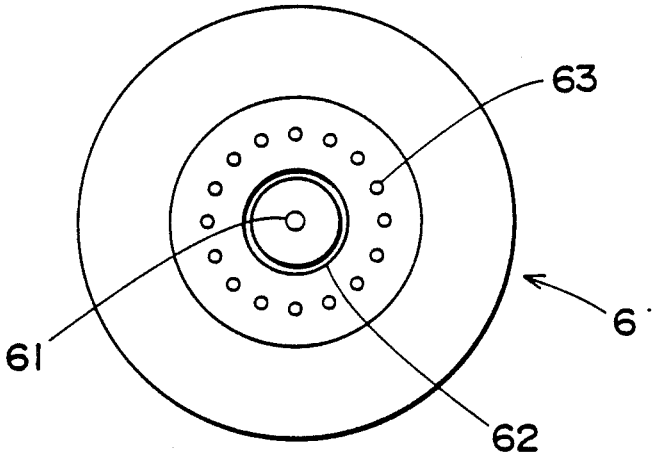
FIG. 11 and FIG. 12 illustrate the structure of an oxygen burner used in the preferred apparatus for refining.
Figure 12:
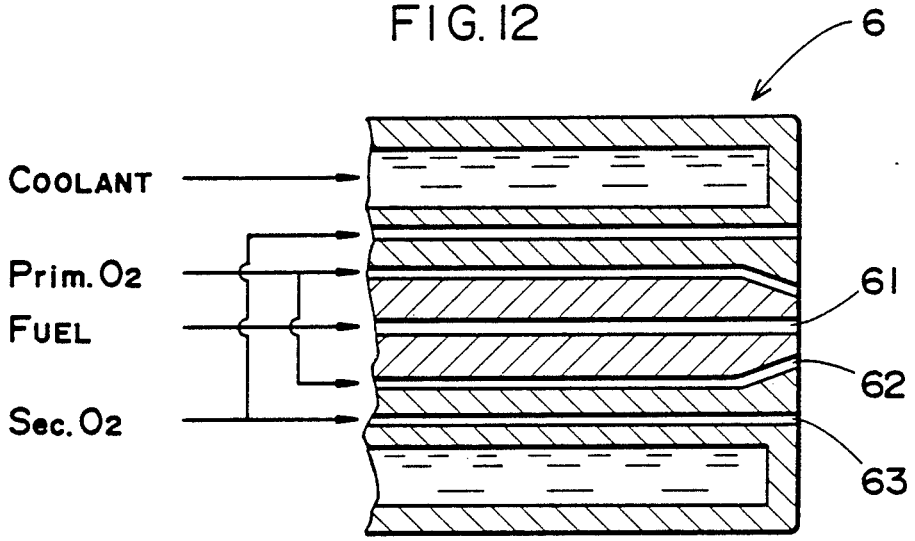

The refining apparatus suitable for practicing the above described still alternative refining method comprises, as illustrated in FIGS. 9 and 10, a furnace body 2 to contain the molten steel 1, a gas supply means 4 for injecting gas into the molten steel to stirr and a burner 6 for supplying heat to the molten steel surface, which is equipped with means for supplying fuel and means for supplying oxygen to the burner: and supplying oxygen to the burner is carried out, as examplified in FIGS. 11 and 12, through both of primary oxygen nozzle 62 which is surrounding fuel nozzle 61 and secondary oxygen nozzle which is circumferencially to the primary oxygen nozzle, and by changing the ratio of the primary oxygen to the total oxygend so that the flame length of the burner may be varied.

The fuel to be burnt with the burner may be any of gas (e.g., propane, natural gas, hydrogen), liquid kerosine, heavy oil) or solid (fine powdered coal).

In FIGS. 9 and 10, reference 3 indicates a furnace lid put on the furnace body. The furnace body 2 has an inclined tapping mouth 5 at the top, and a tuyere 4 for injecting $O_2$ gas and Ar gas at the lower part thereof.

Figure 13:
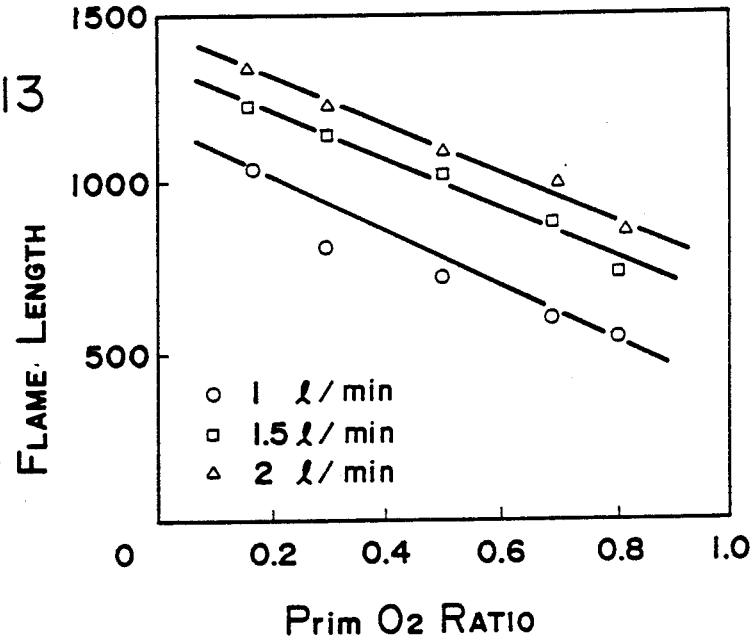
FIG. 13 and FIG. 14 show the performance of the illustrated burner.

Using the burner of the above described structure, it is possible to control the flame length by changing the ratio of the amount of the primary oxygen to the total amount of oxygen supplied to the burner (hereinafter the ratio of primary oxygen/total oxygen is referred to as "primary oxygen ratio"). As shown in FIG. 13, the flame becames long when the primary oxygen ratio is small, and short when the ratio is large.

Figure 14:
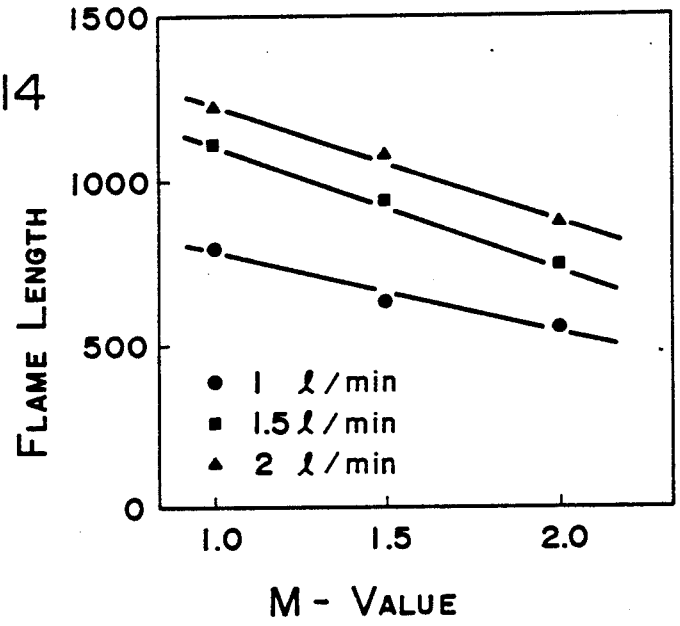

Also, as shown in FIG. 14, at a certain primary oxygen ratio, the higher the percentage of excess oxygen (so-called "M-value") is, the shorter the flame length is.

Accordingly, by choosing these conditions, it is possible to control the flame length in a certain range, for example, 55–140 cm, with a constant burning capacity.

As already explained, the decarburization of the molten steel using $O_2$ gas is carried out by reacting $O_2$ with C to form CO or $CO_2$, $$2C+O_2 \rightarrow 2CO$$

$$2CO+O_2 \rightarrow 2CO_2$$

thus removing C from the molten steel. The $CO_2$ also react with C in the molten steel to cause the decarburization reaction:

$$C+CO_2 \rightarrow 2CO$$

At the former stage of the decarburization, the reaction can be promoted by using long flame of the burner to supply $CO_2$ along with heat. Excess $O_2$ in the flame is of course effective directly for the decarburization. Because the molten steel flows vigorously due to stirring by the injected gas, jetting $CO_2$ and $O_2$ which are oxidizing agents to the molten steel surface results in efficient absorption of both the heat and the oxidizing agents.

As the decarburization proceeds and the C-content becomes lower, the rate determing step of the decarburization reaction changes from oxygen supply to carbon diffusion in the molten steel, and the oxidation loss of valuable metals in the molten steel, particularly, Cr, becomes significant. The border line is, though depending on the contents of Cr, Ni and Mn, and the size and shape of the furnace, approximately C:0.3%.

Therefore, at the latter stage of the decarburization, it is advantageous to use a short flame so that only heat may be given to the molten steel and that neither $CO_2$ nor $O_2$ may be blown to the surface.

EXAMPLES

The present invention will now be illustrated with reference to the particular examples.

EXAMPLE 1

A refining apparatus of the structure shown in FIG. 1 was constructed. The apparatus comprises a furnace body 2 to contain molten steel 1 and a furnace lid 3 thereon. The furnace body 2 is equipped with a inclined tapping mouth 5 at the upper part thereof and a tuyere 4 for injecting $O_2$ gas and Ar gas at the lower part thereof. A burner 6 for supplying heat to the molten steel surface is installed at the furnace lid 3.

Molten steel 23 tons was charged in the furnace body 2, and refining of SUS 304 steel was carried out in 4 stages. Using a molten steel of C-content 0.8 weight %, the refining was carried out while stirring it by injecting $O_2$ gas through the inner tube 4*a* of the tuyere 4, and simultaneously, Ar gas through the outer tube 4*b*, and while heating it by blowing flame 7 from the burner 6 (burning capacity: heavy oil 22 liters/min.).

For comparison, according to the known AOD process, a molten steel of C-content 1.5 weight % was subjected to the refining while it was stirred in the same manner as above, but without heating by the burner.

Figure 2A:
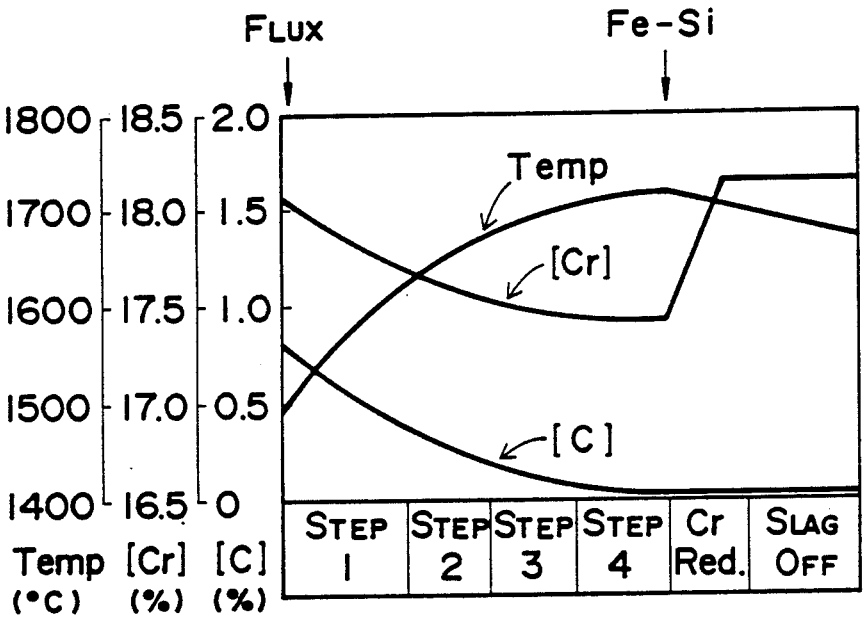
FIG. 2A and FIG. 2B are graphs showing the changes of Cr-content and C-content and temperature change of the molten steel during the refining in the working examples of the present invention and control examples, respectively.
Figure 2B:
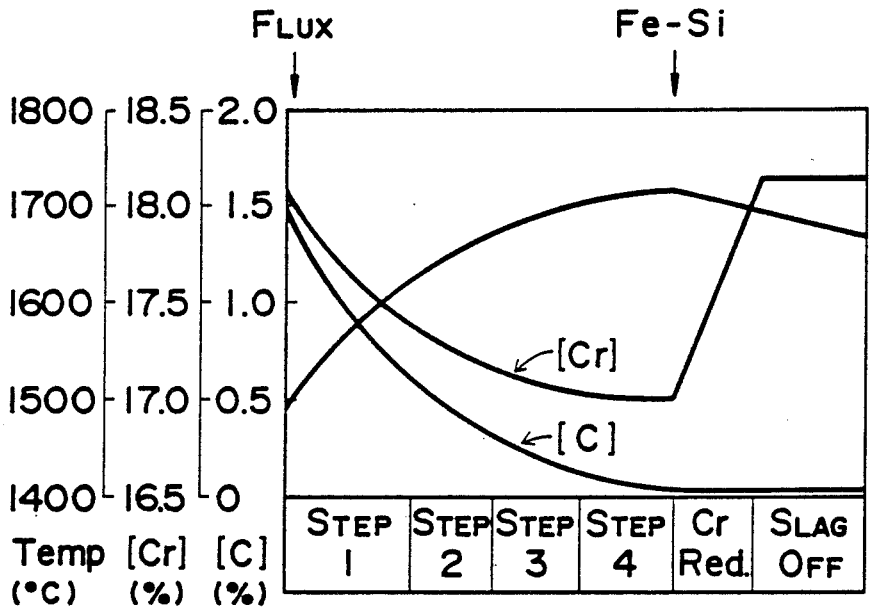

The refinging patterns are shown in Table 1 and FIG. 2A and FIG. 2B. Also, the heat efficiencies in the first and second steps of the refining are shown in Table 2. In Table 2, the sum of the effective heat is the total heat necessary in molten steel temperature rise+melting the alloy+melting the slag.

In this example, oxidation of Cr was suppressed to about a half of the control example. The heating efficiency by the burner 6 was assumed to be 40%.

TABLE 1

| Refining Stages | Control (without burner) Period of Refining (min.) | Control (without burner) C-content in the molten steel (wt %) | Invention (with burner) Period of Refining (min.) | Invention (with burner) C-content in the molten steel (wt %) |
|---|---|---|---|---|
| Before starting | — | 1.5 | — | 0.8 |
| 1st and 2nd stages | 16 | 0.3 | 9(Δ7) | (0.3) |
| 3rd and 4th stages | 25 | 0.005 | 22(Δ3) | 0.005 |
| Reduction of Cr-oxides, and adjustment of alloy composition | | | | |
| Sampling and Slag-off | 22 | — | 19(Δ3) | — |
| Charge | 7 | — | 7 — | — |
| Total | 70 | — | 58(Δ12) | — . |

TABLE 2

| Heat Source | Control (without burner) (Refining period: 16 min.) Heat Generation (Mcal) | Efficiency (%) | Effective Heat (Mcal) | Invention (with burner) (refining period: 9 min.) Heat Generation (Mcal) | Efficiency (%) | Effective Heat (Mcal) |
|---|---|---|---|---|---|---|
| Oxidation of Cr | 1070 | 66.5 | 710 | 540 | (66.5) | 360 |
| Oxidation of Si | 480 | 66.5 | 320 | 480 | (66.5) | 320 |
| C CO | 540 | 66.5 | 360 | 230 | (66.5) | 150 |
| CO CO2 | 420 | (66.5) | 280 | 180 | (66.5) | 120 |
| burner | — | — | — | 1800 | (40.0) | 720 |
| Total | 2510 | 66.5 | 1670 | 3230 | 51.7 | 1670 |

As shown in Table 1, it was possible, according to the invention, to lower the carbon content of the molten steel prior to the refining from 1.5 weight % in the convertional method to 0.8 weight % in the example. Thus, it was realized to curtail the decarburization period of 7 minutes for decreasing the carbon content in the molten steel to 0.3 weight % after completion of the first and the second stages.

Also, as seen from the comparison of FIG. 2A and FIG. 2B, loss of Cr due to the oxidation in the example of the invention (FIG. 2A) was less than in the conventional refining (FIG. 2B), and therefore, the period necessary for reduction of the Cr-oxides in the latter stages was about 3 minutes shortened as seen in Table 1.

Further, less oxidation loss of Cr in the present invention enabled saving of the metallic Si, which was necessary for reducing the Cr-oxides, of about 3.5 Kg/tonmolten steel and curtailment in about 2 minutes of the period for removing the slag. The curtailment of the operation period of 12 minutes in total assured a longer life of the refractory materials.

EXAMPLE 2

Figure 3:
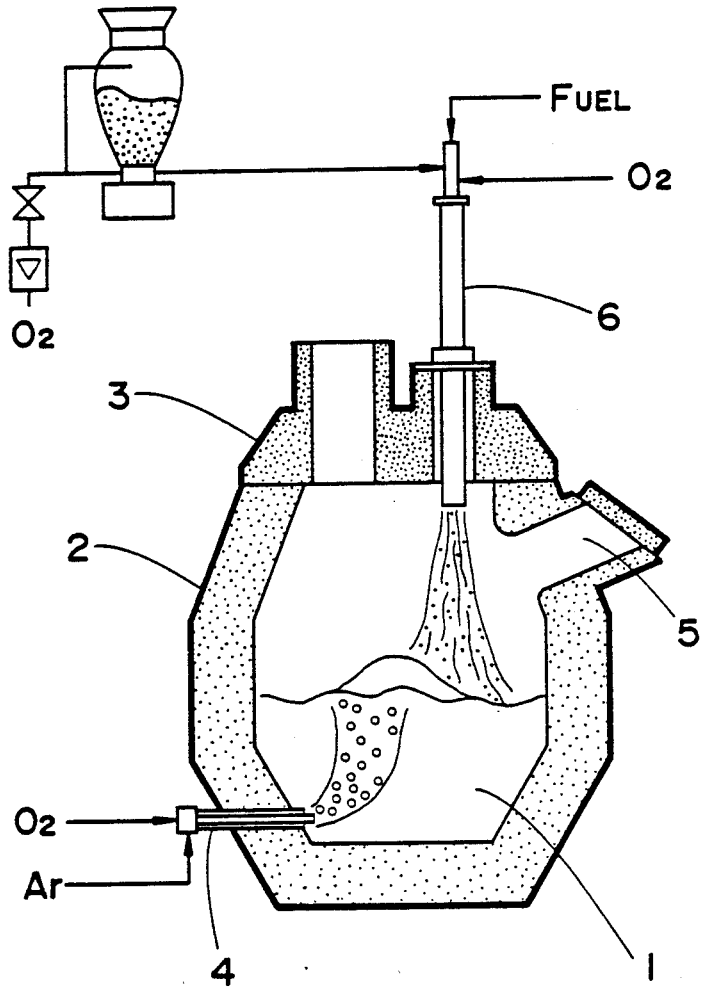
FIG. 3 is a longitudinal sectional view of an apparatus for refining steel used in an alternative embodiment of the invention.

A refining apparatus as shown in FIG. 3 was constructed. The apparatus has, in addition to the structure as used in Example 1, a means for supplying the solid oxygen source to the molten steel surface at the burner 6.

Molten steel 3000 kg prepared in an arc furnace was charged in the above furnace for refining SUS304 steel. The operation conditions were as follows:

| | | |
|---|---|---|
| (Tuyere operation conditions) | | |
| Former stage: | Ar supply | 900 Nl/min. |
| | $O_2$ supply | 1800 Nl/min. |
| | Period | 10 min. |
| Latter stage: | Ar supply | 2000 Nl/min. |
| | $O_2$ supply | 1000 Nl/min. |
| | Period | 19 min. |
| (Burner operation conditions) | | |
| Fuel: | Kerosin 1.0 l/min. | |
| $O_2$ gas: | 2.0 $Nm^3$/min. | |
| Solid oxygen source: | Mill scale (350 mesh pass, 4.0 kg/min.) | |

Figure 4:
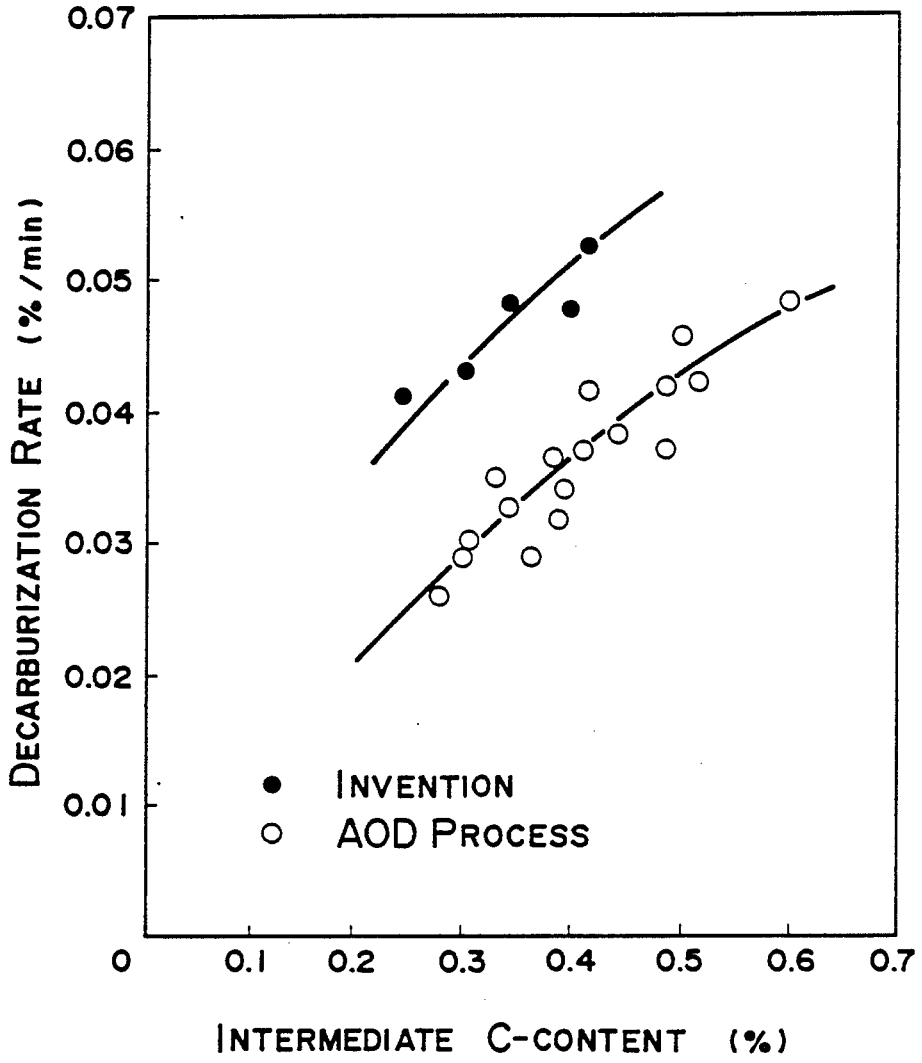
FIG. 4 shows data of the examples, relation between the C-content in the molten steel and decarburization rate in comparison with known AOD process.

Relations between the intermediate C-contents (averages of the carbon contents at the beginning and the end of the decarburization refining) and the rate of decarburization were plotted to give FIG. 4, in which the data of the known AOD process are also shown for comparison.

The graph shows that use of the solid oxygen source according to the present invention promotes the decarburization reaction.

The valuable metals such as Cr in the molten steel were oxidized in an amount as small as 75–65% of the amount in the conventional method, and the reducing agent (ferro-silicon) was saved at 3.5–4.5 kg/ton-steel.

EXAMPLE 3

Figure 5:
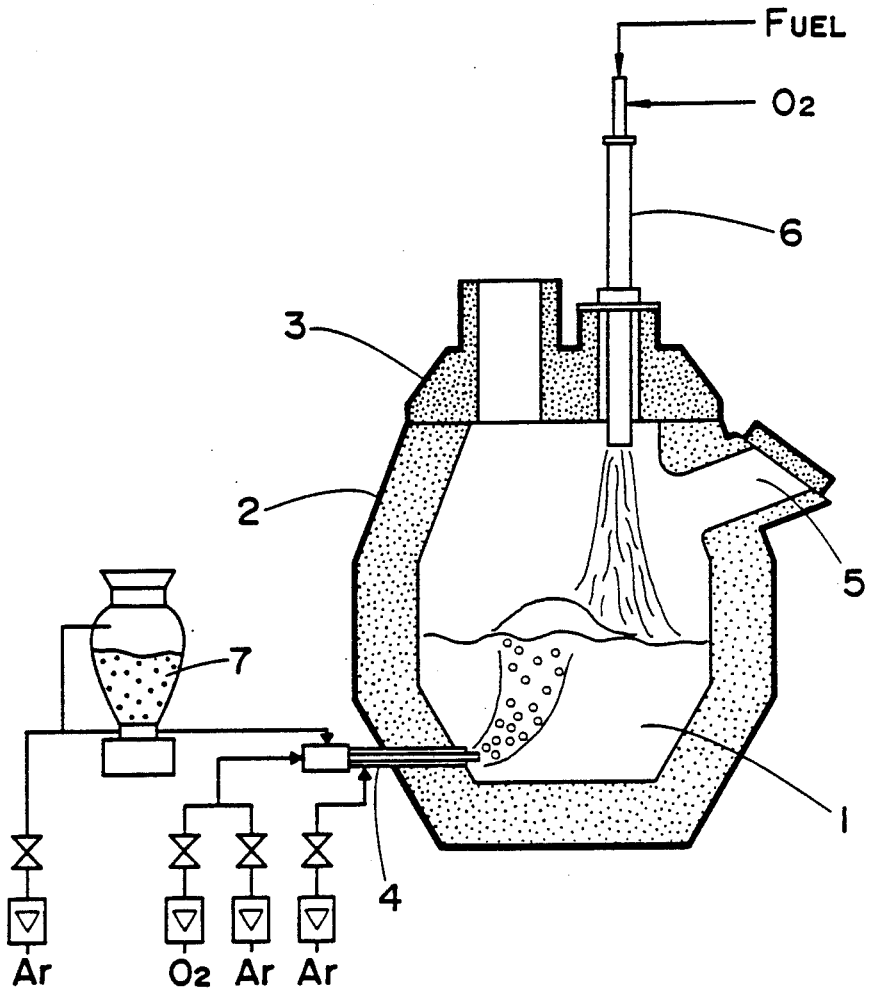
FIG. 5 is a longitudinal sectional view of an apparatus for refining steel used in still other embodiment of the invention.

A refining apparatus as shown in FIG. 5 was constructed. The apparatus has, in addition to the structure used in Example 1 and shown in FIG. 1, a means for injecting solid oxygen source 7 in the powdery form at the tuyere 4.

Molten steel 3000 kg prepared in an arc furnace was charged in this furnace and subjected to refining for obtaining SUS 304 steel.

In the relatively high carbon state (where the intermediate C-conten decrease from 0.6 to 0.2%) and in the relatively low carbon state (where the intermediate C-content decreases from 0.2 to 0.02%), chromite sand (350 mesh pass) or mill scale (the same) was used as the solid oxygen source and injected through the tuyere. The relations between the intermediate C-contents and the decarburization rates were plotted in comparison with the data according to the known AOD process to give FIG. 6 (high carbon state) and FIG. 7 (low carbon state).

For comparison, operations without burner were also carried out.

Figure 6:
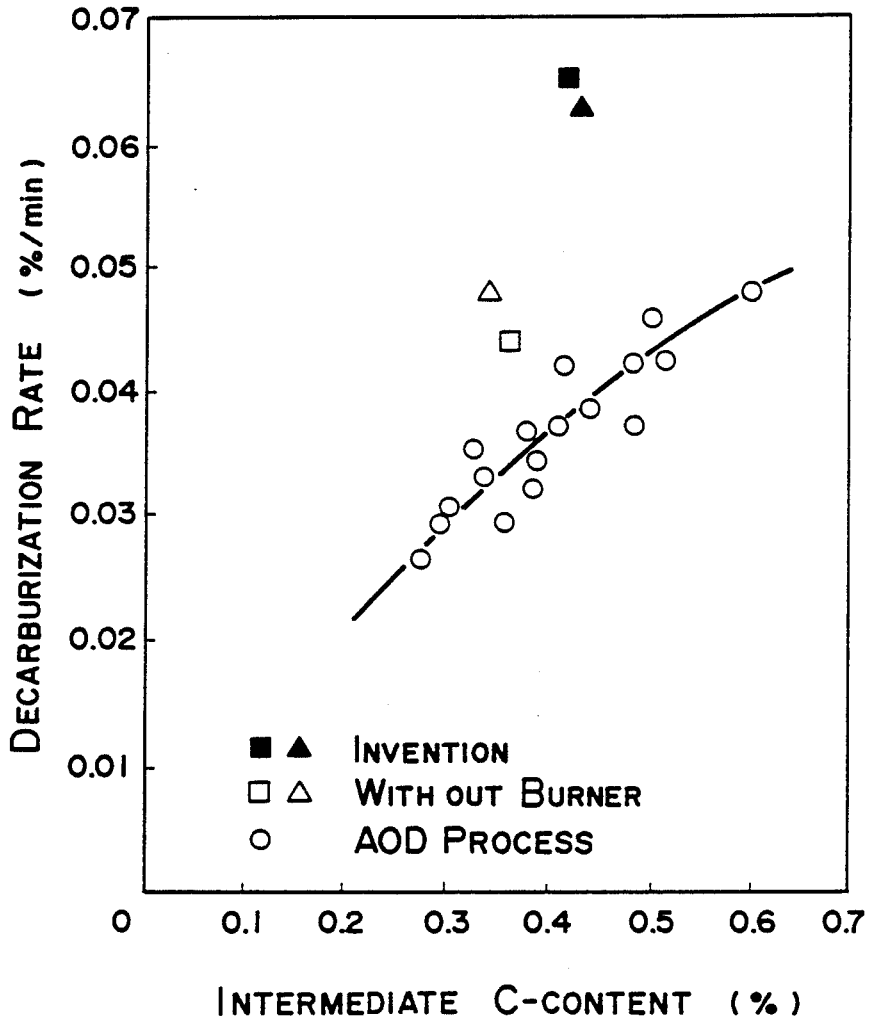
FIG. 6 and FIG. 7 are graphs showing relations between the C-content in the molten steel and decarburization rate of the examples of the invention in comparison with known AOD process.
Figure 7:
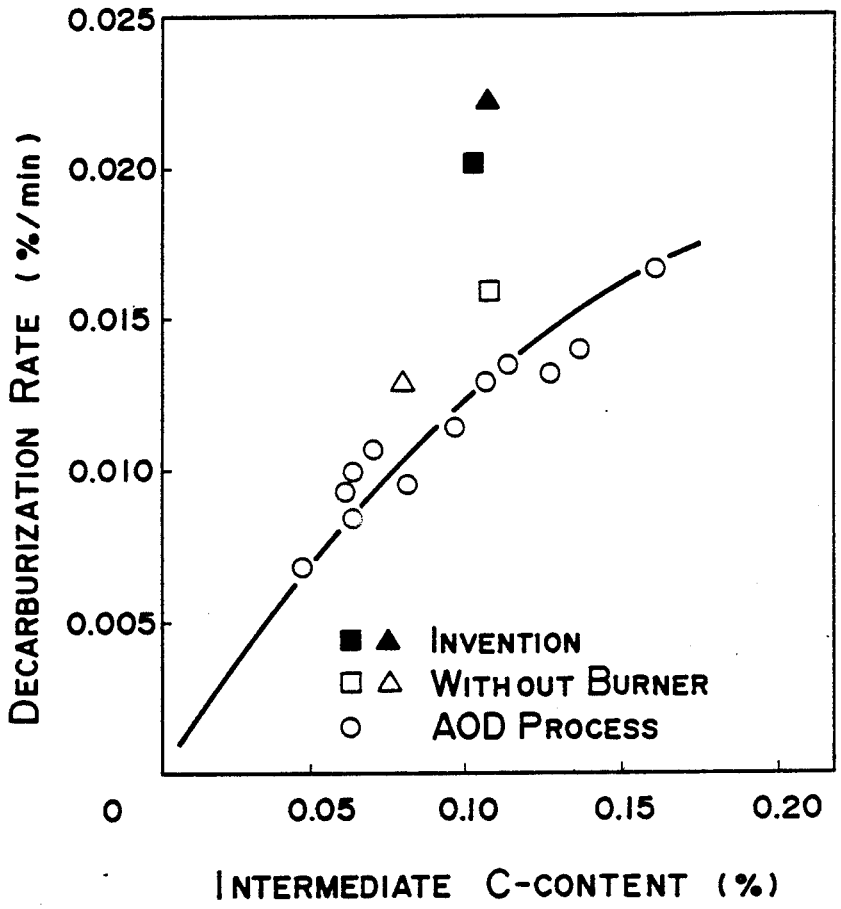

The operation conditions are as follows:

| Reference | O2 ($Nm^3$/min) | Ar | Solid Oxygen Source (kg/min) | Burner Heating |
|---|---|---|---|---|
| (Former stage of decarburization . . . FIG. 6) | | | | |
| Δ | 1.8 | 0.9 | chromite sand 4.0 | no |
| ▲ | 1.8 | 0.9 | chromite sand 4.5 | yes |
| □ | 1.8 | 0.9 | mill scale 3.2 | no |
| ■ | 1.8 | 0.9 | mill scale 3.0 | yes |
| O | 1.8 | 0.9 | — | no |
| (Latter stage of decarburization . . . FIG. 7) | | | | |
| Δ | 1.0 | 2.0 | chromite sand 3.2 | no |
| ▲ | 1.0 | 2.0 | chromite sand 3.3 | yes |
| □ | 1.0 | 2.0 | mill scale 2.3 | no |
| ■ | 1.0 | 2.0 | mill scale 2.3 | no |
| O | 1.0 | 2.0 | — | yes |

The graphs of FIG. 6 and 7 show that show use of the solid oxygen source enhanced the decarburization.

Figure 8:
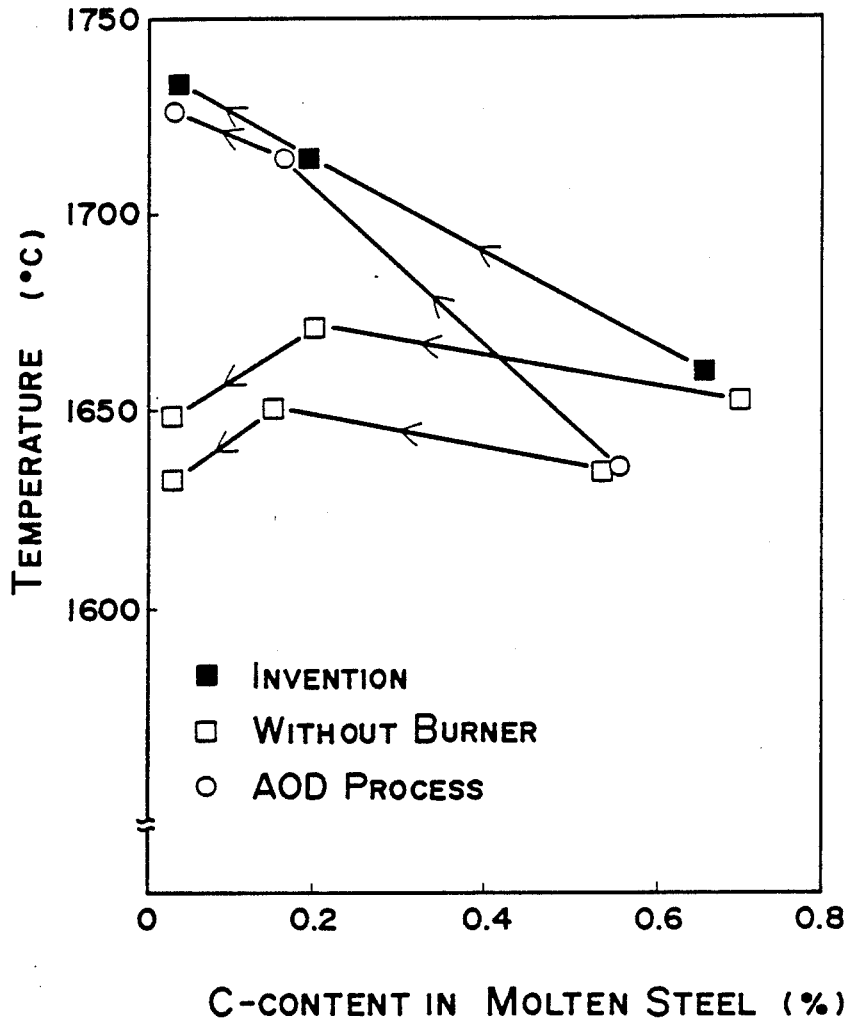
FIG. 8 is a graph showing the data of the examples, relation between the C-content and the temperature of the molten steel.

As to the temperature of the molten steel, the temperature changes accompanying decrease of C-content in the molten steel in the case where the mill scale was used as the solid oxygen source are shown in FIG. 8.

The graph in FIG. 5 shows that, because the decarburization reactions by the solid oxygen sources are endothermic reactions, the temperature drop in the present method is much more than in the AOD process. On the other hand, the temperature drop substantiates that the decarburization by the solid oxygen source actually proceeds. Further, the graph of FIG. 8 proved that the same final refining temperature as that of the AOD process can be attained by using the burner heating according to the present invention.

In the examples of this invention the valuable metals such as Cr in the molten steel were oxidized only to the extent of 60–70% of the conventional technology, and saving of the reducing agent (ferrosilicon) was 4–5 kg/ton-steel. In the cases where no burner heating was used, oxidation of the valuable metals was in the level of 80–70% of the conventional technology, and the reducing agent of 2–3 kg/ton-steel was saved.

EXAMPLE 4

A refining apparatus of the structure shown in FIGS. 9 and 10 as constructed. The burner has, as illustrated in FIGS. 11 and 12, a fuel nozzle 61 at the center and a slit-shaped primary oxygen nozzle 62 surrounding the fuel nozzle, and a secondary oxygen nozzle 63 consisting of multiple holes distributed on a circle around the primary oxygen nozzle. The slits of the primary oxygen nozzle has a somewhat concentrical taper.

Kerosin was fed to the burner. Oxygen in various amounts just necessary for burning the kerosin was also fed with different primary oxygen ratios. The flame length varied as shown in FIG. 13, which shows that, the higher the primary oxygen ratio, the longer the flame length is. Variation of the "M-value" under a constant primary oxygen ratio resulted in the tendency that, as shown in FIG. 14, at a higher M-value the flame length become somewhat shorter.

The above refining apparatus received each 3 tons of molten steel prepared in an arc furnace, which was refined to produce SUS 304 steel in accordance with the present method or the known AOD process.

The operation conditions are as follows:

| Burner operation conditions | Former Stage | Latter State |
|---|---|---|
| Fuel supply (kerosin) | 2.01 l/min | 1.0 l/min |

-continued

| | | |
|---|---|---|
| M-value | 1.0 | 1.0 |
| Primary oxygen ratio | 0.2 | 1.0 |
| Flame length | 140 cm | 55 cm |
| Tuyere operation conditions | Present Invention | AOD Process |
| (Former Stage) | | |
| Ar injection | 900 Nl/min | 900 Nl/min |
| O2 injection | 1800 Nl/min | 1800 Nl/min |
| Period | 10 min | 22 min |
| (Latter Stage) | | |
| Ar injection | 2000 Nl/min | 2000 Nl/min |
| O2 injection | 1000 Nl/min | 1000 Nl/min |
| Period | 19 min | 19 min |

Figure 15:
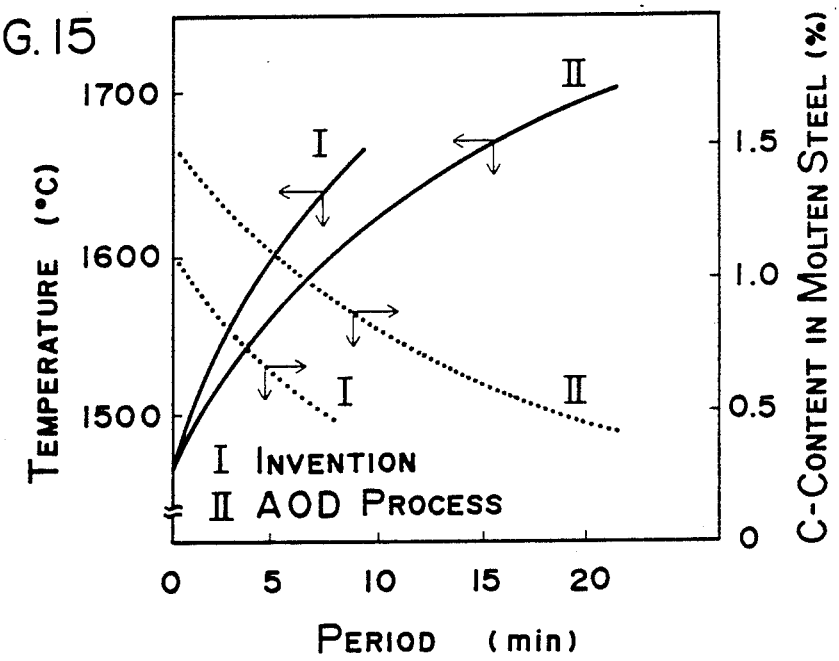
FIG. 15 and FIG. 16 show the data of the examples using the refining apparatus in which the above burner is installed.
Figure 16:
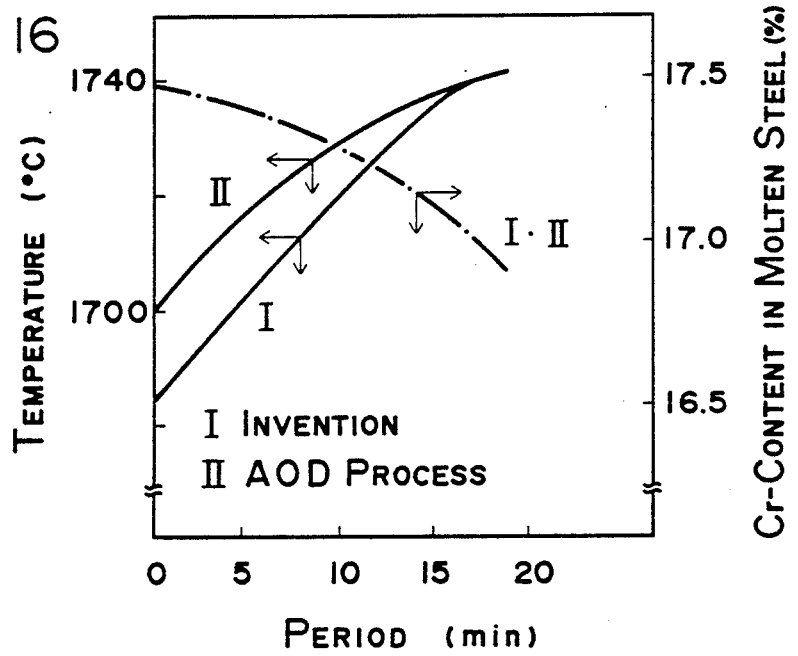

Rise of the molten steel temperature and decrease of C-content in the molten steel during the former stage of the decarburization is shown in FIG. 15, and rise of the molten steel temperature and decrease of Cr-content in the molten steel during the latter stage of the decarburization is shown in FIG. 16.

The graph in FIG. 15 shows that the decarburization according to the present method proceeds more quickly than in the AOD process. Because the molten steel temperature rises due to the burner heating, the present method can start at a carbon content lower than that used in the AOD process. Also, even in the latter stage of the decarburization, the burner heating helps the temperature rise, and this enables starting at a lower initial C-content and curtails the period of the former stage of the decarburization.

The graph of FIG. 16 shows that the temperature rise is rapid also at the latter stage of the decarburization according to the present invention, and hence, even if the molten steel temperature at the beginning of the latter stage is low, it will reach a necessary level in the same period of time as that of the AOD process, and that the oxidation loss of Cr during the latter stage is approximately equal to that of the AOD process.

We claim:

1. A method of refining steel which comprises carrying out the refining while stirring molten steel in a furnace by injecting gas thereinto, and while supplying heat by a burner equipped at the top of the furnace to the molten steel through the surface thereof enlarged due to the stirring.

2. A method of refining steel according to claim 1, wherein the gas injected into the molten steel is an oxidative gas.

3. A method of refining steel according to claim 1, wherein the gas injected into the molten steel is an inert gas.

4. A method of refining steel according to one of claims 1–3, wherein an oxygen enriched gas containing 30 volume % or more of $O_2$ is fed to the burner so as to obtain a flame of a high temperature.

5. A method of refining steel according to claim 1, wherein oxygen is supplied in an amount excess to the theoretical amount necessary for burning the fuel in the state where the C-content in the molten steel is high and oxygen supply is rate determining to the decarburization reaction.

6. A method of refining steel according to claim 5, wherein the supply of oxygen is carried out through the burner to the molten steel surface.

7. A method of refining steel according to claim 5, wherein the supply of oxygen is carried out through a device separate to the burner to the molten steel surface.

8. A method of refining steel which comprises carrying out the refining while stirring molten steel in a furnace by injecting gas thereinto, while supplying heat by a burner equipped at the top of the furnace to the molten steel through the surface thereof enlarged due to the stirring, and while supplying a solid oxygen source in the form of metal oxide powder by a carrier gas through the burner and shooting it with the flame of the burner to the molten steel surface.

9. A method of refining steel according to claim 8, wherein one or more of metal oxides which are reducable equally to or more easily than chromium oxides are used.

10. A method of refining steel according to claim 9, wherein the metal oxide used is one or more selected from the group consisting of chromite sand, mill scale, iron ore, nickel oxide, molybdenum oxide and tangsten oxide.

11. A method of refining steel according to claim 8, wherein the $O_2$ gas for burning the fuel is utilized as the carrier gas for the powdery solid oxygend source.

12. A method of refining steel which comprises carrying out the refining while stirring molten steel in a furnace by injecting gas thereinto, and while supplying heat with a burner equipped at the top of the furnace to the molten steel through surface thereof enlarged due to the stirring, wherein a solid oxygen source in metal oxide powder form is added to the molten steel with the above stirring gas through a tuyere or an immersed lance.

13. A method of refining steel according to claim 12, wherein one or more of metal oxides which are reducable equally to or more easily than chromium oxides are use.

14. A method of refining steel according to claim 13, wherein the metal oxide used is one or more selected from the group consisting of chromite sand, mill scale, iron ore, nickel oxide, molybdenum oxide and tangsten oxide.

15. A method of refining steel which comprises carrying out the refining while stirring molten steel in a furnace by injecting gas thereinto, and while supplying heat with an oxygen burner equipped at the top of the furnace to the molten steel through the surface thereof enlarged due to the stirring, wherein at the former stage of decarburization (the stage of higher carbon content where oxygend supply is the rate-determining to the decarburization reaction) the flame of the burner is so long that the flue gas is jetted to the molten steel to promote the decarburization, and at the latter stage of decarburization (the stage of lower carbon content where carbon diffusion in the molten steel is rate-determining to the decarburization reaction) the flame of the burner is so short that only the heat is transferred to the molten steel.

16. A method of refining steel according to claim 15, wherein the steel is a chromium-containing steel.

* * * * *